US010518556B2

(12) United States Patent
LeFevre et al.

(10) Patent No.: US 10,518,556 B2
(45) **Date of Patent: *Dec. 31, 2019**

(54) INTEGRATED OBJECT PACKAGING AND HOLDER FOR DIRECT-TO-OBJECT PRINTER

(71) Applicant: Xerox Corporation, Norwalk, CT (US)

(72) Inventors: Jason Matthew LeFevre, Penfield, NY (US); Douglas K. Herrmann, Webster, NY (US); Paul McConville, Webster, NY (US); Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/117,001

(22) Filed: Aug. 30, 2018

(65) Prior Publication Data

US 2018/0370251 A1 Dec. 27, 2018

Related U.S. Application Data

(62) Division of application No. 15/477,224, filed on Apr. 3, 2017, now Pat. No. 10,086,625.

(51) Int. Cl.

| | |
|---|---|
| ***B41J 3/407*** | (2006.01) |
| ***B41M 5/00*** | (2006.01) |
| ***B41J 29/38*** | (2006.01) |
| ***B65D 73/00*** | (2006.01) |
| ***B65D 79/00*** | (2006.01) |

(52) U.S. Cl.

CPC ..... *B41J 3/4073* (2013.01); *B41J 29/38* (2013.01); *B41M 5/0088* (2013.01); *B65D 73/0007* (2013.01); *B65D 79/00* (2013.01)

(58) Field of Classification Search

CPC . B41J 11/70; B41J 11/66; B41J 11/663; B41J 11/666; B41J 11/68; B41J 15/04; B41J 11/0095; B41J 11/42; B41J 11/006; B41J 3/4073; B41M 5/0088

See application file for complete search history.

(56) References Cited

U.S. PATENT DOCUMENTS

| | | | |
|---|---|---|---|
| 9,156,281 | B2 | 10/2015 | Dubuit et al. |
| 9,272,815 | B2 | 3/2016 | Uptergrove |
| 9,302,506 | B2 | 4/2016 | Uptergrove et al. |
| 9,403,383 | B1 | 8/2016 | Liu et al. |
| 9,434,180 | B2 | 9/2016 | Onodera et al. |
| 9,463,649 | B1 | 10/2016 | Liu et al. |
| 9,511,607 | B2 | 12/2016 | LeFevre |
| 2010/0013880 | A1 | 1/2010 | Polk et al. |
| 2010/0186610 | A1 | 7/2010 | Polk et al. |

(Continued)

*Primary Examiner* — Julian D Huffman

(74) *Attorney, Agent, or Firm* — Fox Rothschild LLP

(57) ABSTRACT

A system for printing on a multi-dimensional object includes a plurality of print heads, a mounting structure configured to receive an integrated object packaging and holder for an object and to movably mount on a support member, an actuator configured to move the mounting structure along the support member, and a processing device. The system also includes a non-transitory, computer-readable memory containing programming instructions that are configured to cause the processing device to control a movement of the mounting structure relative to the plurality of print heads, and operate the plurality of print heads to eject marking material onto an object mounted on the mounting structure.

6 Claims, 8 Drawing Sheets

(56) References Cited

U.S. PATENT DOCUMENTS

| | | | |
|---|---|---|---|
| 2010/0315459 | A1 | 12/2010 | Chang et al. |
| 2012/0147074 | A1 | 6/2012 | Ikeda et al. |
| 2013/0342592 | A1 | 12/2013 | Merz |
| 2014/0029030 | A1 | 1/2014 | Miller |
| 2015/0298394 | A1 | 10/2015 | Sheinman |

INTEGRATED OBJECT PACKAGING AND HOLDER FOR DIRECT-TO-OBJECT PRINTER

CROSS-REFERENCE TO RELATED APPLICATIONS

This application claims priority to, and is a divisional application of U.S. patent application Ser. No. 15/477,224, filed Apr. 3, 2017, the disclosure of which is incorporated by reference herein in its entirety.

BACKGROUND

Distinguishing consumer products, such as beverages, sports memorabilia, fashion accessories etc., from those of competitors in an attractive and interesting manner increases sales and consumption of the product. The visual appeal of a product may be optimized to appeal to a target market by adding designs on the product or the product container that appeal to the consumers. Furthermore, vendors or service providers often like to personalize their products to advertise the services offered to make the item more fun and entertaining, commemorate a special occasion, or the like. However, while printing on objects during the mass-manufacturing process itself is widely known (e.g., ball skins are printed with patterns or logos prior to the ball being completed and inflated during manufacturing), techniques for individualized printing on objects having curved, non-planar, or non-linear surfaces are generally limited and also very expensive.

For example, current systems for printing on an object having curved, non-planar, or non-linear surfaces require an object holder to hold the object steady while its position and/or orientation is carefully varied with respect to a print head by moving the object holder and/or the print head. Such object holders must be custom designed and made for each object (or for each batch of similar objects) to be printed, requiring additional resources and time which significantly adds to the cost of printing. Moreover, custom designed object holders also take up significant storage space.

These same objects often require some form of packaging for effective transportation, storage and/or disposal purposes. Such packaging must be discarded and/or temporarily removed for printing on the object further adding to cost and effort for printing directly on the object.

This document describes devices and methods that are intended to address issues discussed above and/or other issues.

SUMMARY

In various embodiments, a system for printing on a multi-dimensional object may include a plurality of print heads, a mounting structure, an actuator, and a processing device. The mounting structure may be configured to receive an integrated object packaging and holder for an object and to movably mount on a support member. The actuator may be configured to move the mounting structure along the support member. The system may also include a non-transitory, computer-readable memory containing programming instructions that are configured to cause the processing device to control a movement of the mounting structure relative to the plurality of print heads, via the actuator, and operate the plurality of print heads to eject marking material onto an object mounted on the mounting structure. Controlling the movement of the mounting structure may include receiving identifying information corresponding to an integrated packaging and object holder mounted on the mounting structure, retrieving, using the identifying information, information relating to the integrated packaging and object holder and an object held within the integrated packaging and object holder, determining, using the retrieved information, a position of at least one printable area on the object with respect to the plurality of print heads, and using the determined position to control the movement of the mounting structure relative to the plurality of print heads.

In certain embodiments, the system may receive the identifying information from an identification tag included in the integrated object packaging and holder. In various embodiments, the information relating to the integrated packaging and object holder and the object held within the integrated packaging and object holder may include one or more of the following: a type of the object held within the integrated packaging and object holder; a number of objects held within the integrated packaging and object holder; information regarding one or more characteristics of the object; information regarding a printable area of the object; information regarding one or more characteristics of the integrated packaging and object holder; or a location of the object within the integrated packaging and object holder.

In another aspect of the current disclosure, a method for printing on a multi-dimensional object may include controlling a movement of a mounting structure relative to a plurality of print heads, wherein a multi-dimensional object is held within an integrated packaging and object holder mounted on the mounting structure by a processor. The movement of the mounting structure may be controller by receiving identifying information corresponding to the integrated packaging and object holder mounted on the mounting structure, retrieving information relating to the integrated packaging and object holder and the multi-dimensional object held within the integrated packaging and object holder using the identifying information, determining a position of at least one printable area on the multi-dimensional object with respect to the plurality of print heads using the retrieved information, and using the determined position to control the movement of the mounting structure relative to the plurality of print heads. The method may also include operating the plurality of print heads to eject marking material onto the multi-dimensional object mounted on the mounting structure. The identifying information may be received from an identification tag included in the integrated object packaging and holder.

In various embodiments, the information relating to the integrated packaging and object holder and the multi-dimensional object held within the integrated packaging and object holder may include one or more of the following: a type of the object held within the integrated packaging and object holder; a number of objects held within the integrated packaging and object holder; information regarding one or more characteristics of the object; information regarding a printable area of the object; information regarding one or more characteristics of the integrated packaging and object holder; or a location of the object within the integrated packaging and object holder.

In yet another aspect of this disclosure, an integrated packaging and object holder configured to attach to a mounting structure of a system for printing on a three-dimensional object may include a packaging unit comprising one or more holding portions, and at least one mating element configured to engage a complementary structure of a mounting structure of a system for printing on a three-dimensional object. Each of the one or more holding portions may be configured to hold an object. In some embodiments, the integrated packaging and object holder may include an identification tag that includes identification information relating to the integrated packaging and object holder. In some embodiments, the at least one mating element may be a tab, a flange, a groove, a mating hole, and/or a mating pin. In various embodiments, the at least one mating element is removable from the packaging unit. Alternatively and/or additionally, the at least one mating element is permanently attached to the packaging unit.

DETAILED DESCRIPTION

Figure 1:
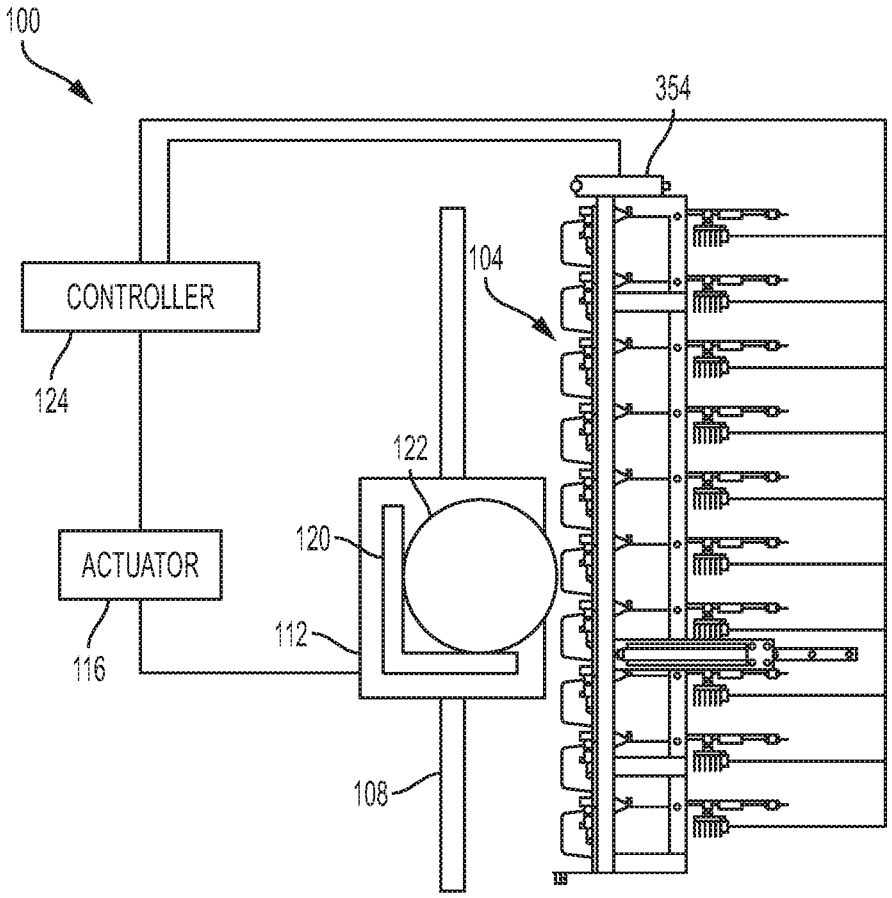
FIG. 1 illustrates an example of a print system for printing on a 3-dimensional object, according to an embodiment.

This disclosure is not limited to the particular systems, methodologies or protocols described, as these may vary. The terminology used in this description is for the purpose of describing the particular versions or embodiments only, and is not intended to limit the scope.

As used in this document, any word in singular form, along with the singular forms "a," "an" and "the," include the plural reference unless the context clearly dictates otherwise. Unless defined otherwise, all technical and scientific terms used herein have the same meanings as commonly understood by one of ordinary skill in the art. All publications mentioned in this document are incorporated by reference. Nothing in this document is to be construed as an admission that the embodiments described in this document are not entitled to antedate such disclosure by virtue of prior invention. As used herein, the term "comprising" means "including, but not limited to."

The term "object" refers to a print media substrate that is made of any multi-dimensional material. An object may include planar, curved, non-planar, or non-linear surfaces. Content may be printed on the print media substrate using toner and/or ink. The object may, for example, include one or more areas comprising characters, and one or more other areas comprising images. Examples of objects which can be printed as described below include, without limitation, round, spherical, rectangular, square, oval, or curved objects such as sporting balls, various types of containers (such as mugs, bottles, etc.), textile materials (such as fabrics used in clothing, hats, footwear, or other apparel), pens, photoframes, ceramics, or the like.

A "print device" or "print engine" is a device that is configured to print content on an object based on digital data, or a multi-functional device in which one of the functions is printing content based on digital data. Example components of a print device include a print head, which may include components such as a print cartridge containing ink, toner or another print material so that the print head can print characters and/or images on the object.

A "print system" is a system of hardware components that include a print device and other components. For example, a printing system may include a marking engine (i.e., the print hardware or print engine) and a digital front end. A digital front end (DFE) is an integrated print workflow management system, including one or more processing devices, capable of receiving and processing print requests and controlling the operation of a print engine to fulfill the print request. The DFE and print engine may be part of a single device (such as a digital printing press), or separate parts of a system of networked devices.

A "processor" or "processing device" is a hardware component of an electronic device that is configured to execute programming instructions. The term "processor" may refer to either a single processor or to multiple processors that together implement various steps of a process. Unless the context specifically states that a single processor is required or that multiple processors are required, the term "processor" includes both the singular and plural embodiments.

The term "integrated" refers to a collection of distinct elements or components that have been built into one packaging unit which can be removable in certain embodiments.

This document describes an integrated object packaging and holder that may be used to mount an object held within the packaging to a print system via a mounting structure when causing a print system to print on the object. An integrated object packaging and holder may serve the conventional purpose of effective transportation and/or storage in addition to being used as an object holder within a print system, without damaging the packaging itself. In this system, the mounting structure helps in the alignment of integrated object packaging and holder and provides accurate registration of the object(s). In this way, printing on an object in its original packaging may be performed without wasting time and resources for designing and manufacturing object holders for each type of object, regardless of the dimensions, shape, or other characteristics of the object, and without compromising on the registration.

FIG. 1 illustrates an example of a print system for printing on an object. In some embodiments, the print system 100 may include an array or other set of print heads 104, a support member 108, a moving sled 112 movably mounted to the support member 108, an actuator 116 operatively connected to the moving sled 112, an object holder 120 configured to mount to the moving sled 112, and a controller 124 in communication with the print heads 104 and the actuator 116. As shown in FIG. 1, the array of print heads 104 may be arranged in a two-dimensional array, (e.g., a 10×1 array), although other array configurations can be used. In some embodiments, the controller 124 is also operatively connected to an optical sensor 354.

In some embodiments, each print head may be fluidly connected to a supply of marking material (not shown) and is configured to eject marking material received from the supply. In various embodiments, one or more of the print heads may be connected to the same supply. Alternatively and/or additionally, each print head may be connected to its own supply such that each print head may eject a different marking material.

In various embodiments, the support member 108 may be positioned to be parallel to a plane formed by the array of print heads and, as shown in FIG. 1, is oriented so one end of the support member 108 is at a higher gravitational potential than the other end of the support member. This orientation enables the printing system 100 to have a smaller footprint than an alternative embodiment that horizontally orients the array of print heads. While the of FIG. 1 illustrates a single rail acting as a support member 108, it will be understood to those skilled in the art that a plurality of rails disposed parallel to each other are within the scope of this disclosure.

In some embodiments, a moving sled 112 is movably mounted to the support member 108 to enable the moving sled to slide along the support member. In some embodiments, the moving sled 112 may move bi-directionally along the support member. In other embodiments, the support member 108 may be configured to provide a return path to the lower end of the support member to form a track for the movably mounted member. In some embodiments, an actuator 116 may be operatively connected to the moving sled 112 and configured to move the moving sled 112 along the support member 108 such that the object holder 120 connected to the moving sled 112 may pass the array of print heads 104 in one dimension of the two-dimensional array of print heads. In the embodiment, the object holder 120 moves an object 122 along the length dimension of the array of print heads 104. In some embodiments, the gap presented between the objects carried by the object holder 120 and the print heads of the array of print heads 104 is in a range of about five to about six mm.

The controller 124 is configured with programmed instructions stored in a memory in communication with the controller so the controller can execute the programmed instructions to operate components in the printing system 100. In some embodiments, the controller 124 may be configured to provide instruction to the actuator 116 to move the object holder 120 past the array of print heads 104. The controller may also be configured to operate the array of print heads 104 to eject marking material onto objects held by the object holder 120 as the object holder passes the array of print heads 104.

Figure 2:
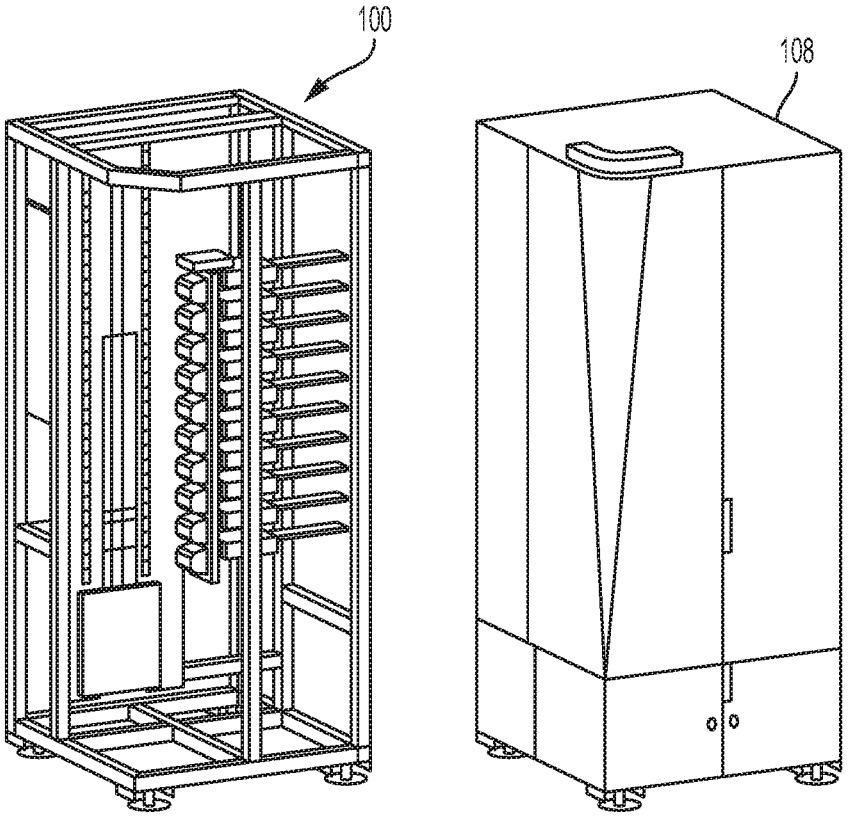
FIG. 2 illustrates an example cabinet within which the print system if FIG. 1 may be installed, according to an embodiment.

In various embodiments, the system configuration such as that shown in FIG. 1 may be housed in a single cabinet 180, as depicted in FIG. 2, and installed in non-production outlets. Once installed, various object holders, as described further below, can be used with the system to print a variety of goods that are generic in appearance until printed.

Figure 3A:
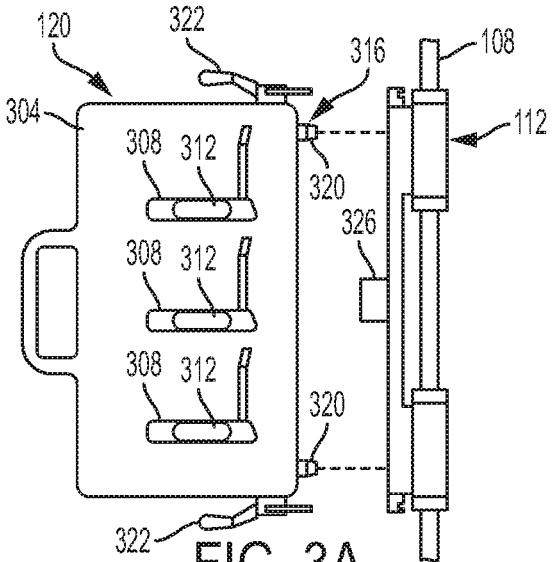
FIG. 3A PRIOR ART
FIGS. 3A and 3B illustrate a front view and a back view, respectively, of a prior art customized object holder for mounting an object in the print system of FIG. 1, according to an embodiment.
Figure 3B:
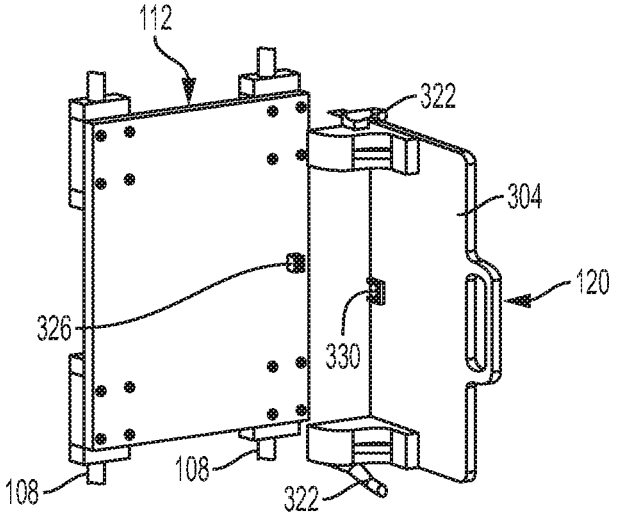
FIG. 3B PRIOR ART

An example of a prior art customized prior art object holder 120 is shown in FIG. 3A. As shown in FIG. 3A, the object holder 120 includes a plate 304 having apertures 308 in which objects 312, which are golf club heads in the figure, are placed for printing. A latch 316 is configured for selectively mounting the object holder 120 to the moving sled 112. The latch 316 includes locating features 320 to aid in properly positioning the object holder 120 for securing the holder to the moving sled 112, which is supported by members 108 as shown in FIG. 3A. Once properly positioned, levers 322 operate the latch 316 to secure the holder 120 to the moving sled 112. FIG. 3B shows a front view of the object holder 120 secured to the moving sled 112. However, as discussed above, in the prior art an object holder for a print system configured to print on 3D objects must be individually tooled or manufactured for each type of object, which leads to unnecessary consumption of resources, time, and money. This document describes an integrated object packaging system and object holder for use with a print system such as that of FIG. 1 and FIG. 2.

Packaging for the most part has been designed with a single use intended, that being to get an item from one point to another with no damage occurring to the contents. Seldom is packaging designed to have more than one functional use to the end consumer.

Figure 4:
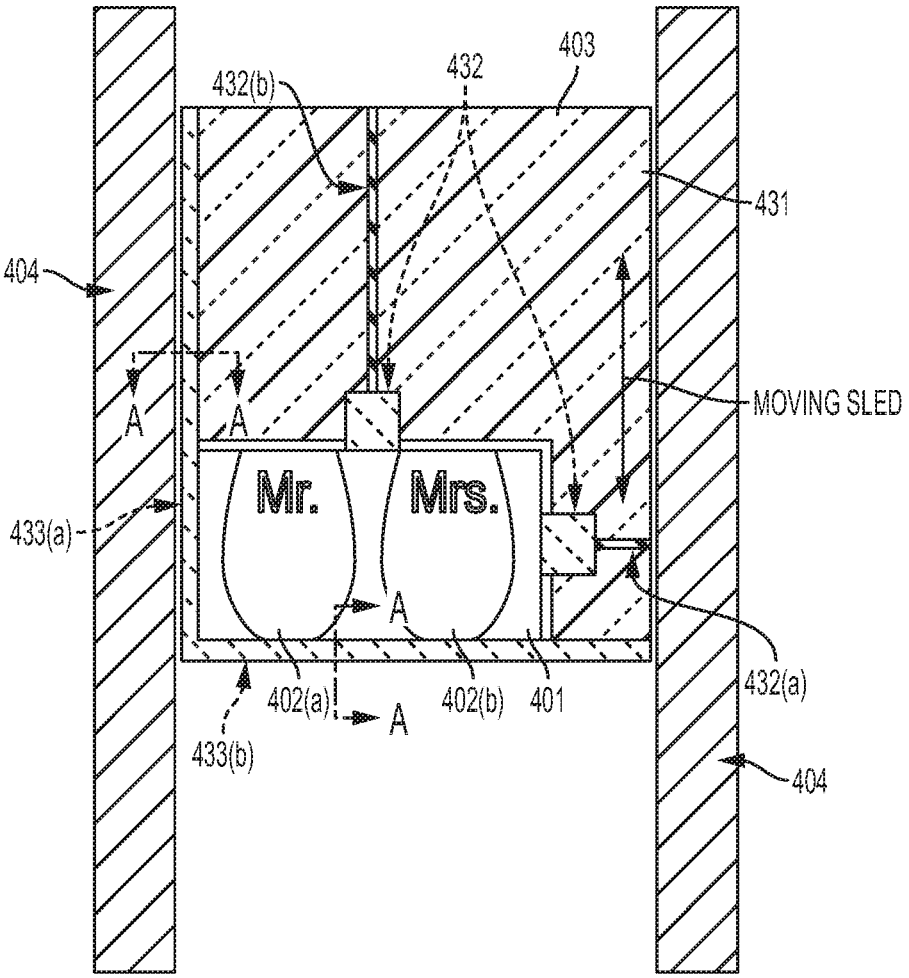
FIG. 4 illustrates an integrated object packaging and holder mounted on a mounting structure for mounting an object in the print system of FIG. 1, according to an embodiment.

Referring now to FIG. 4, the current disclosure describes an integrated object packaging and holder 401 that may be used to mount one or more objects 402(*a*), 402(*b*) . . . 402(*n*) to a mounting structure 403 (e.g., a modified moving sled of a print system described above). The mounting structure 403 is also configured to be movably mounted on a support system 404 (e.g., a pair of slider rails) of a print system of FIG. 1 described above.

As shown in FIG. 4, a mounting structure 403 configured to mount an integrated object packaging and holder is illustrated. The mounting structure 403 may include a base 431 configured to be movably mounted on a print system support system, one or more locking assemblies 432, and one or more alignment assemblies 433(*a*) and 433(*b*). In various embodiments, an integrated packaging and object holder (described below) 401 is mounted on the mounting structure 403 using the locking assemblies and/or the alignment assemblies.

In various embodiments, the base 431 is generally square or rectangular shaped structure and may include various features such as bores and apertures to facilitate securement of other device components thereto and/or for securing the base 431 to a support system of a print system. A size of the base 431 may be configured such that one or more objects included in an integrated packaging and object holder may be mounted on the base 431. In an example embodiment, a guide system (not shown here) may be included in the base 431 and positioned so as to engage a support system (such as rails or conveyor system) of a print system and move the mounting structure 403 in the desired direction. In some embodiments, the base 431 may also include various elements such as hinges or other rotational means for changing the orientation of the mounting structure 403 with respect to the support system of the print system.

In various embodiments, a locking assembly 432 may be configured to secure an integrated object packaging and holder to the mounting structure 403. For example, as shown in FIG. 4, a locking assembly may be a clamping device that includes a clamping arm which pivots between a released and a clamped position. A clamping device may be held in the clamped position through a variety of means, including maintaining the force applied to the handle or the actuating arm of the clamp. Clamp mechanisms of this type utilize a power cylinder, either pneumatic or hydraulic. Various types of a releasable latch assembly are also known to those skilled in the art to hold a clamping device in both a clamped, locked position or an unclamped, released position. In some embodiments, the clamping device may also be configured to have an adjustable position depending upon the size, shape, orientation, etc. of the object holder. For example, a clamping device may be attached to a moving mechanism (such as sliding rails 432(*a*) and 432(*b*), respectively) to accurately position the clamping device in its clamping position based on the size, shape, orientation, etc. of the object holder.

Other examples of locking assemblies may include, tensioning and securing devices such as, without limitation, a spring-loaded locking mechanism, threaded rods type locking mechanism, bar clamps, or the like.

While FIG. 4 illustrates two locking assemblies, it will be understood to those skilled in the art that any number of locking assemblies may be used to securely hold an object holder on a mounting structure without deviating from the principles of the current disclosure.

In some embodiments, an alignment assembly may be configured to accurately and reliably align an integrated object packaging and holder 401 with respect to the mounting structure 403. This allows a controller of a print system to accurately determine the position of one or more objects (and/or each printable area of each object) included in the integrated object packaging and holder 401 with respect to the print heads ("registration"). A skew, lateral misalignment or error in the registration of the object holder can lead to errors, such as image and/or color registration errors. One or more alignment assemblies of the current disclosure align an integrated object packaging and holder to a "datum," or a reference location on the mounting structure. In other words, the alignment assembly precisely and accurately locates, aligns and orients an integrated object packaging and holder relative to a datum on the mounting structure. An alignment assembly includes an engagement structure configured to engage and hold a complementary structure (mounting element(s)) of the object holder to be mounted and aligned on the mounting structure.

Figure 5:
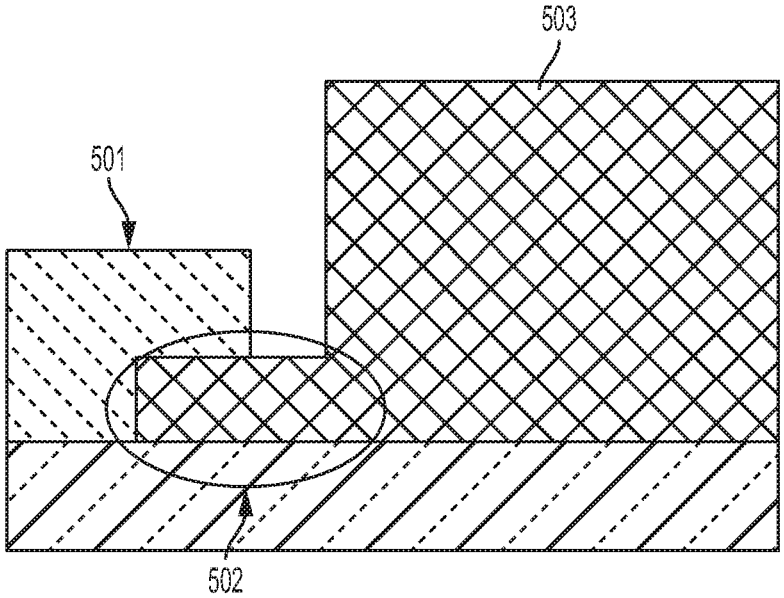
FIG. 5 illustrates a cross-section view of an alignment assembly of a mounting structure, according to an embodiment.

FIG. 4 illustrates an example of an alignment assembly that includes an engagement structure such as one or more grooves (or a continuous channel) provided in at least two perpendicular adjoining edges of the base 431 of a mounting structure 403 for engaging and holding complementary flanges (or tabs) of an object holder. As shown in FIG. 4, continuous channels 433(*a*) and 433(*b*) may engage and/or hold complementary flanges (or tabs) of an integrated object packaging and holder. The channel 433(*a*) provides accurate registration in the y-direction and the channel 433(*b*) provides accurate registration in the x-direction. In various embodiments, dimensions of the channel (such as depth and width) may be defined so as to provide proper registration of an object holder when engaged. FIG. 5 illustrates a cross-section view of an alignment assembly (a groove or a channel 501) that is configured to mate with a flange or a tab 502 of an object holder 503.

Other examples of an engagement structures may include, without limitation, registration holes, registration pins, registration tabs, or the like configured for engaging complementary mating elements on the object holder. In certain other embodiments, the alignment assembly may include sensors such as electrical contact sensors for maintaining alignment of the edges of an object holder (without engagement).

Figure 6A:
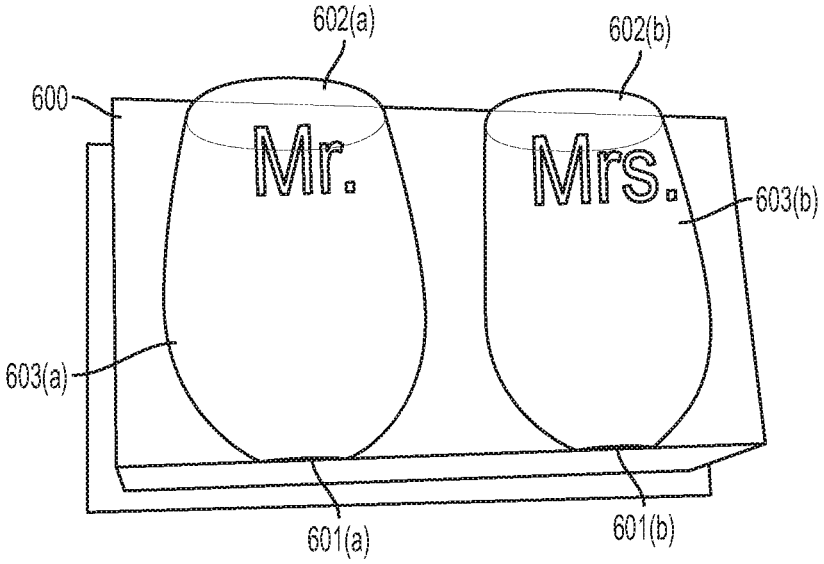
FIG. 6A illustrates a conventional packaging unit for packaging and shipping an object, according to an embodiment.

Referring now to FIG. 6A, a conventional generally rectangular shaped configuration 600 (a packaging unit) for packaging and shipping one or more objects is illustrated. The packaging unit 600 may be formed using any suitable material such as cardboard, plastic, glass, rubber, foam, resins or the like.

As shown in FIG. 6A, the packaging unit 600 may include one or more holding portions 601(*a*) and 601(*b*), where each holding portion is configured to securely hold an object 602(*a*) and 602(*b*), respectively. For instance, the holding portions 601(*a*) and 601(*b*) may form generally a silhouette of the shape of the object held within such that the object fits within its corresponding holding portion and movement is limited. Limited or restricted movement allows for accurate registration of each object with respect to the print heads during printing. To that end, it should be noted that the interior of the packaging unit 600 may include materials, such as rubber or foam, for absorbing shock to further prevent movement damage and/or internal structures such as side supporting walls.

In various embodiments, each holding portion is configured to hold an object such that at least a part of the object is not covered (or exposed) by a packing material and may form a "printable area" 603(*a*) and 603 (*b*). Alternatively and/or additionally, a printable area of an object may be covered by a removable packaging material (such as a transparent cover) that may be removed without damaging the packaging unit 600 before printing on the objects. In various embodiments, each object may include one or more printable areas.

Figure 6B:
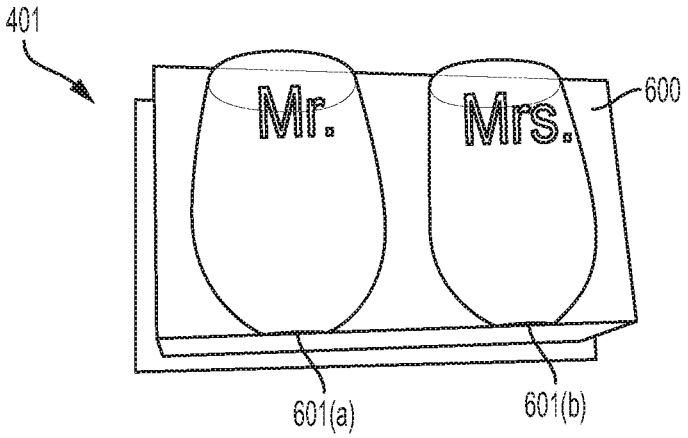
FIG. 6B depicts a front perspective view of an integrated object packaging and holder, according to an embodiment.

Referring now to FIG. 6B, a front perspective view of an integrated object packaging and holder 401 configured to be mounted on a mounting structure of FIG. 4 is illustrated. As shown in FIG. 6B, an integrated packaging and object holder may include a packaging unit 600 (such as that described above with respect to FIG. 6) that includes at least one mating element 610(*a*) and 610(*b*) on at least two of its perpendicular and adjoining sides. Examples of mating elements may include, without limitation, tabs or flanges molded (or attached by other suitable means) into a peripheral edge of the packaging unit. The mating elements are configured to be complementary (in size, shape, position, number, etc.) to the alignment assemblies of a mounting structure of a print system to be used for printing on the objects held by the integrated object packaging and holder 401. The mating elements may be removable (such as molded using perforated lines) or permanently molded. Other examples of mating elements may include, without limitation, mating pins, mating grooves, mating holes, or the like.

In some embodiments, the mating elements are positioned such that when engaged with a mounting structure, each printable area of the objects held by the integrated packaging and object holder is properly aligned and oriented with respect to the print heads of a print system, and their position is accurately registered with respect to the print heads. For example, as shown in FIG. 6B, the mating elements 610(*a*) and 610(*b*) are located along the perimeter of a surface of the packaging unit that is directly opposite the surface that provides the printable area of the objects 602(*a*) and 602(*b*). In other words, the surface of an object holder that includes the mating elements 610(*a*) and 610(*b*) is captured on a base of a mounting structure when engaged such that the printable areas of the objects held within are exposed to the print heads of a print system.

While the above description describes that the alignment assemblies of a mounting structure include grooves or channels for receiving complementary mating elements (such as tabs), it will be understood to those skilled in the art that all now or hereafter known alignment assemblies and mating elements that form a pair of complementary structures that can engage to align an integrated object packaging and holder are within the scope of this disclosure. For example, tabs orientated in a perpendicular direction with respect to a base may be provided on a mounting structure and may be configured to engage a channel included in the integrated object packaging and holder.

In various embodiments, an integrated object packaging and holder 401 may also include an identification tag (not shown here) for providing identification and/or information regarding the integrated object packaging and holder 401 to a controller of a print system. Examples of such identification systems may include, barcodes attached to or printed on the integrated object packaging and holder, radio frequency identification (RFID) tags, QR codes or other barcodes, integrated chips, or the like.

Figure 7:
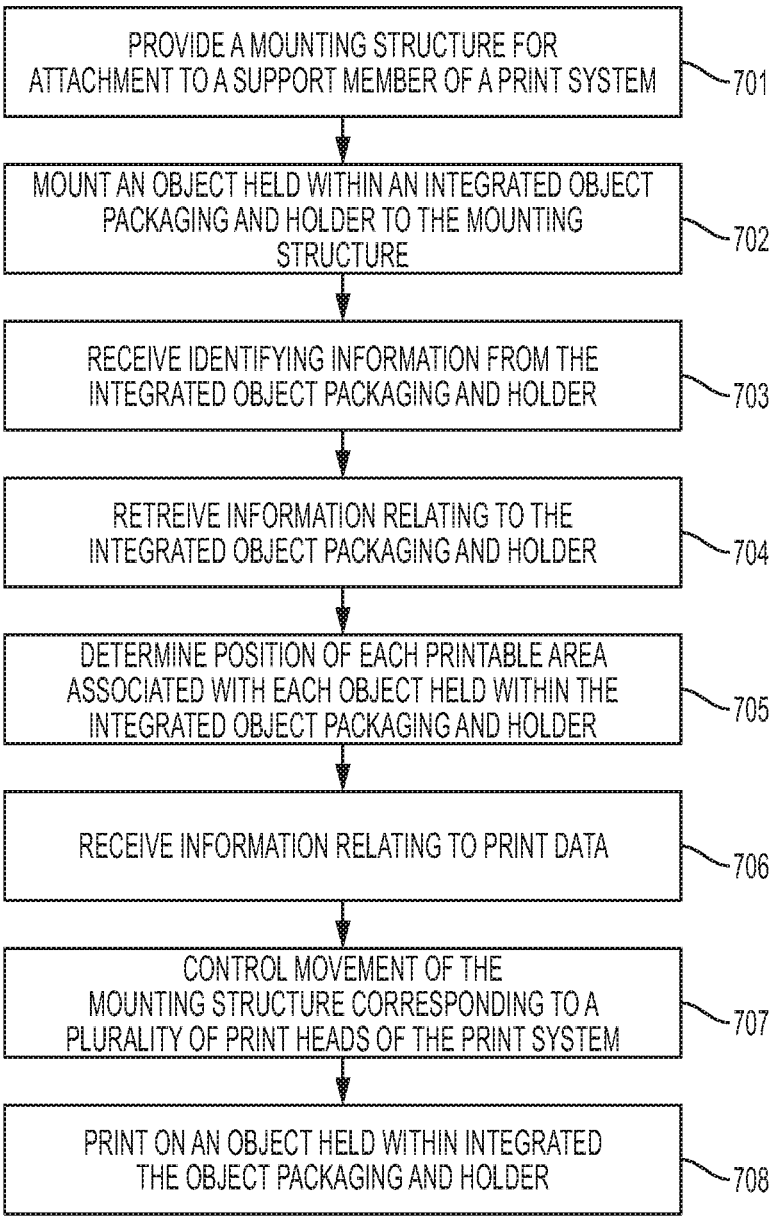
FIG. 7 depicts a flowchart illustrating an example method of a using an integrated object packaging and holder for printing on an object, according to an embodiment.

Referring now to FIG. 7, an example flowchart describing a method for using an integrated object packaging and holder for printing on one or more objects is illustrated.

In step 701, a mounting structure that includes locating and alignment assemblies is provided for attachment to a support member of a print system. In step 702, an object held within an integrated object packaging and holder including complementary mating elements may be mounted and aligned on the mounting structure.

Next, the print system may receive (step 703) identifying information corresponding to the integrated object packaging and holder. In some embodiments, the system may receive the information by, for example, scanning a barcode or like attached to the integrated object packaging and holder, from an RFID tag, using optical character recognition (OCR), scanning an image attached to the integrated object packaging and holder, or the like. Examples of identifying information may include, without limitation, stock keeping unit number (SKU), a universal product code (UPC), an International Article Number (EAN), model numbers, product manufacturer name, product name, or the like.

The print system may then retrieve (step 704) more information relating to the integrated object packaging and holder and the objects held within using the identifying information. For example, the print system may access a database such as a product registration database and retrieve the above information using the identified information. Examples of information relating to the integrated object packaging and holder and the objects held within may include, without limitation, type of objects held within the integrated object packaging and holder, the number of objects included in integrated object packaging and holder, information regarding the objects (such as shape, dimensions, material, etc.), information regarding the "printable area" of each object (such as shape, dimensions, material, etc.), information regarding a packaging unit (such as shape, dimensions, material, etc.), location of each object (and/or printable area) within a packaging unit, or the like.

The print system may use the retrieved information to determine (step 705) the position of each printable area associated with each object held within the integrated object packaging and holder mounted on the mounting structure with respect to the print heads (i.e., register each printable area).

In step 706, the print system receive information relating to print data to be printed on each printable area and may control the movement (step 707) using the registration information and the print data information.

In step 708, the print system may print on the objects as discussed above with respect to FIG. 1.

It should be noted that while the above disclosure describes embodiments that include a mounting structure movable along the length dimension of an array of print heads, and the print heads are stationary, it will be understood to those skilled in the art that the print heads may also be movable to provide a relative motion between the print heads and the mounting structure. Alternatively, the mounting structure may be stationary and only the array of print heads may be movable.

Figure 8:
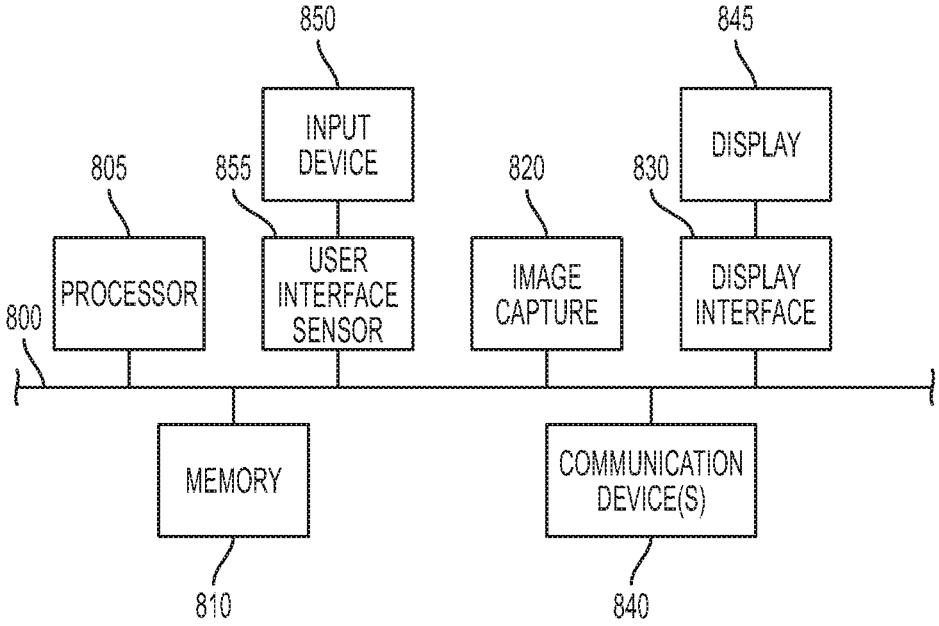
FIG. 8 depicts various embodiments of one or more electronic devices for implementing the various methods and processes described herein.

FIG. 8 depicts an example of internal hardware that may be included in any of the electronic components of the print system, such as the controller, or the print device. An electrical bus 800 serves as an information highway interconnecting the other illustrated components of the hardware. Processor 805 is a central processing device of the system, configured to perform calculations and logic operations required to execute programming instructions. As used in this document and in the claims, the terms "processor" and "processing device" may refer to a single processor or any number of processors in a set of processors. Read only memory (ROM), random access memory (RAM), flash memory, hard drives and other devices capable of storing electronic data constitute examples of memory devices 810. A memory device may include a single device or a collection of devices across which data and/or instructions are stored.

An optional display interface 830 may permit information from the bus 800 to be displayed on a display device 845 in visual, graphic or alphanumeric format. An audio interface and audio output (such as a speaker) also may be provided. Communication with external devices may occur using various communication devices 840 such as a transmitter, transceiver, antenna, communications port or a similar device. A communication device 840 may be attached to a communications network, such as the Internet, a local area network or a cellular telephone data network.

The hardware may also include a user interface sensor 855 that allows for receipt of data from input devices 850 such as a keyboard, a mouse, a joystick, a touchscreen, a remote control, a pointing device, a video input device and/or an audio input device. Data also may be received from an image capturing device 820, such of that a scanner or camera.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A system for printing on a multi-dimensional object, the system comprising:

a plurality of print heads;

a mounting structure configured to receive an integrated object packaging and holder for an object and to movably mount on a support member;

an actuator configured to move the mounting structure along the support member;

a processing device; and a non-transitory, computer-readable memory containing programming instructions that are configured to cause the processing device to:

control a movement of the mounting structure relative to the plurality of print heads, via the actuator, by:

receiving identifying information corresponding to an integrated packaging and object holder mounted on the mounting structure, retrieving, using the identifying information, information relating to the integrated packaging and object holder and an object held within the integrated packaging and object holder, determining, using the retrieved information, a position of at least one printable area on the object with respect to the plurality of print heads, and using the determined position to control the movement of the mounting structure relative to the plurality of print heads, and operate the plurality of print heads to eject marking material onto an object mounted on the mounting structure.

2. The system of claim 1, receiving identifying information corresponding to the integrated packaging and object holder mounted on the support structure comprises receiving the identifying information from an identification tag included in the integrated object packaging and holder.

3. The system of claim 1, wherein the information relating to the integrated packaging and object holder and the object held within the integrated packaging and object holder comprises one or more of the following:

a type of the object held within the integrated packaging and object holder;

a number of objects held within the integrated packaging and object holder;

information regarding one or more characteristics of the object;

information regarding a printable area of the object;

information regarding one or more characteristics of the integrated packaging and object holder; or a location of the object within the integrated packaging and object holder.

4. A method for printing on a multi-dimensional object, the method comprising:

by a processor, controlling a movement of a mounting structure relative to a plurality of print heads, wherein a multi-dimensional object is held within an integrated packaging and object holder mounted on the mounting structure, by:

receiving identifying information corresponding to the integrated packaging and object holder mounted on the mounting structure;

retrieving, using the identifying information, information relating to the integrated packaging and object holder and the multi-dimensional object held within the integrated packaging and object holder;

determining, using the retrieved information, a position of at least one printable area on the multi-dimensional object with respect to the plurality of print heads; and using the determined position to control the movement of the mounting structure relative to the plurality of print heads; and by the processor, operating the plurality of print heads to eject marking material onto the multi-dimensional object mounted on the mounting structure.

5. The method of claim 4, receiving the identifying information corresponding to the integrated packaging and object holder mounted on the support structure comprises receiving the identifying information from an identification tag included in the integrated object packaging and holder.

6. The method of claim 4, wherein the information relating to the integrated packaging and object holder and the multi-dimensional object held within the integrated packaging and object holder comprises one or more of the following:

a type of object held within the integrated packaging and object holder;

a number of objects held within the integrated packaging and object holder;

information regarding one or more characteristics of an object;

information regarding a printable area of an object;

information regarding one or more characteristics of the integrated packaging and object holder; or a location of the object within the integrated packaging and object holder.

* * * * *